US011447294B2

(12) United States Patent
Bischoff et al.

(10) Patent No.: US 11,447,294 B2
(45) Date of Patent: Sep. 20, 2022

(54) SET CONSISTING OF AT LEAST TWO CONTAINERS, EACH OF WHICH HAS A DIFFERENT INNER VOLUME

(71) Applicant: MAUSER-WERKE GMBH, Bruehl (DE)

(72) Inventors: Sebastian Bischoff, Niederkassel (DE); Daniel Siede, Pulheim (DE)

(73) Assignee: MAUSER-WERKE GMBH, Bruehl (DE)

( * ) Notice: Subject to any disclaimer, the term of this patent is extended or adjusted under 35 U.S.C. 154(b) by 838 days.

(21) Appl. No.: 16/076,291

(22) PCT Filed: Feb. 10, 2016

(86) PCT No.: PCT/EP2016/000221
§ 371 (c)(1),
(2) Date: Aug. 7, 2018

(87) PCT Pub. No.: WO2017/137053
PCT Pub. Date: Aug. 17, 2017

(65) Prior Publication Data
US 2021/0188483 A1 Jun. 24, 2021

(51) Int. Cl.
*B65D 21/02* (2006.01)
*B65D 1/22* (2006.01)

(52) U.S. Cl.
CPC ..... *B65D 21/0233* (2013.01); *B65D 1/22* (2013.01)

(58) Field of Classification Search
CPC ..... B65D 21/0233; B65D 21/0204; B65D 21/02; B65D 21/0201; B65D 21/04;
(Continued)

(56) References Cited

U.S. PATENT DOCUMENTS 3,279,640 A * 10/1966 Dodson ..... B65D 7/045 220/4.04
3,369,694 A * 2/1968 Mauser ..... B65D 21/0219 220/611
(Continued)

FOREIGN PATENT DOCUMENTS

CA 2773810 A1 * 10/2012 ..... B29C 45/0081
DE 2263280 A1 7/1973
(Continued)

OTHER PUBLICATIONS

International Search Report for International Application No. PCT/EP2016/000221, dated Oct. 13, 2016.

*Primary Examiner* — J. Gregory Pickett
*Assistant Examiner* — Abigail Elizabeth Guidry
(74) *Attorney, Agent, or Firm* — Marshall, Gerstein & Borun LLP

(57) ABSTRACT

A set of at least two containers each having different internal volumes, wherein the opening cross sections of all of the containers are identical, and at least one wall portion of the respective casing of all of the containers in each case has: (1)

a rectilinear portion in which, in each vertical projection plane parallel to a vertical axis of the container, the at least one wall portion leaves behind two trace lines which diverge toward the opening cross section and each enclose an angle (α) of at least 2 degrees with the vertical axis, and (2) a transition portion assembled from two arc portions and the intersection curve of which with each vertical projection plane parallel to the vertical axis of the container merges tangentially both into the rectilinear portion and a respective intersection curve of the base.

6 Claims, 7 Drawing Sheets

(58) Field of Classification Search
CPC ..... B65D 21/0217; B65D 21/0222; B65D 21/0219; B65D 21/041; B65D 21/08; B65D 21/0209; B65D 21/0212; B65D 1/22; B65D 81/2007; B65D 81/2038; B65D 90/503; B65D 2519/00328; B65D 2543/00148
See application file for complete search history.

(56) References Cited

U.S. PATENT DOCUMENTS

| | | | | | |
|---|---|---|---|---|---|
| 3,693,828 | A * | 9/1972 | Kneusel | B65D 1/165 | 220/608 |
| 3,784,052 | A * | 1/1974 | Edwards | B65D 1/265 | 206/520 |
| 3,895,743 | A * | 7/1975 | Christian | B65D 47/06 | 222/143 |
| 4,051,951 | A * | 10/1977 | Smith | B65D 21/0222 | 206/508 |
| 4,366,696 | A * | 1/1983 | Durgin | B65D 21/0233 | 72/339 |
| D279,251 | S * | 6/1985 | Daenen | D7/614 | |
| 4,756,420 | A * | 7/1988 | Deaton | B65D 1/22 | 206/514 |
| 5,678,716 | A * | 10/1997 | Umiker | B65D 11/1866 | 220/23.83 |
| 6,170,696 | B1 * | 1/2001 | Tucker | B65D 1/26 | 206/508 |
| 6,467,647 | B1 * | 10/2002 | Tucker | B65D 1/26 | 206/508 |
| 6,886,694 | B2 * | 5/2005 | McNeeley | B65D 21/02 | 206/505 |
| 6,935,525 | B2 * | 8/2005 | Trude | B65D 1/0223 | 215/381 |
| 10,308,401 | B2 * | 6/2019 | Ng | B65D 21/0217 | |
| 10,479,554 | B2 * | 11/2019 | Dziaba | B65D 43/0212 | |
| 2002/0148840 | A1 * | 10/2002 | Torniainen | B65D 21/0233 | 220/657 |
| 2004/0035867 | A1 * | 2/2004 | Schultz | B65D 51/249 | 220/212 |
| 2004/0155048 | A1 * | 8/2004 | R. Aiken | B65D 21/0219 | 220/801 |
| 2004/0256275 | A1 * | 12/2004 | Diamond | B65D 21/0219 | 206/508 |
| 2005/0040068 | A1 * | 2/2005 | Palder | B65D 1/22 | 206/499 |
| 2006/0186014 | A1 * | 8/2006 | Ramanujam | B65D 21/0223 | 206/508 |
| 2007/0187277 | A1 * | 8/2007 | Furlong | B65D 21/0223 | 206/515 |
| 2007/0272580 | A1 * | 11/2007 | Bellon | B65D 21/0233 | 206/515 |
| 2008/0000795 | A1 * | 1/2008 | Deakin | A47G 19/23 | 206/508 |
| 2009/0058008 | A1 * | 3/2009 | Baumgartner | B29C 51/10 | 273/408 |
| 2009/0173656 | A1 * | 7/2009 | Furlong | B65D 21/022 | 206/508 |
| 2010/0243503 | A1 * | 9/2010 | Krueger | A23L 35/00 | 206/459.5 |
| 2012/0024856 | A1 * | 2/2012 | Smyers | A47G 19/26 | 220/324 |
| 2012/0273381 | A1 * | 11/2012 | Ulmer | B65D 43/0206 | 206/505 |
| 2017/0036805 | A1 * | 2/2017 | Lotfi | B65D 1/40 | |
| 2017/0273753 | A1 * | 9/2017 | Bischoff | B65D 43/14 | |
| 2017/0334612 | A1 * | 11/2017 | Middleton | B65D 43/0212 | |
| 2018/0282021 | A1 * | 10/2018 | Cziraky | B65D 21/0233 | |
| 2019/0233164 | A1 * | 8/2019 | Blitzer | A01G 9/02 | |

FOREIGN PATENT DOCUMENTS

| | | | | |
|---|---|---|---|---|
| DE | 29515199 | U1 * | 1/1996 | B65D 51/20 |
| DE | 20203592 | U1 | 10/2002 | |
| DE | 202014003590 | U1 * | 7/2014 | B65D 21/0233 |
| WO | WO-2006091655 | A1 * | 8/2006 | B65D 43/0212 |
| WO | WO-2011154800 | A1 * | 12/2011 | B65D 21/0222 |

* cited by examiner

SET CONSISTING OF AT LEAST TWO CONTAINERS, EACH OF WHICH HAS A DIFFERENT INNER VOLUME

CROSS-REFERENCE TO RELATED APPLICATIONS

This is the United States National Stage of PCT Application No. PCT/EP2016/000221, filed Feb. 10, 2016, the entire contents of which are incorporated herein by reference.

FIELD OF DISCLOSURE

The invention relates to a set consisting of at least two containers each having different internal volumes, wherein the containers each have:

a base, a casing adjoining the latter in an encircling manner, and an opening cross section which is defined by an end of the casing that faces away from the base and opens up access to the respective internal volume, wherein at least one wall portion of the respective casing runs at an inclination in relation to a vertical axis of the container, said vertical axis running perpendicularly to the base, in such a manner that an internal cross section of the container that is defined in each case by the casing decreases continuously from the opening cross section as far as the base, and the opening cross sections of all of the containers of the set are identical.

BACKGROUND

Containers are used for many purposes and serve in particular for storing, transporting, collecting and disposing of substances or materials, wherein containers are known in any size and shape. Waste containers which are provided for use in hospitals, veterinary clinics, and doctor and dentist practices and also in medical research and development laboratories where in particular infectious waste arises are only used once and are disposed of together with the waste located therein after they have been closed in a suitable manner. For this reason, it is necessary in these use sectors to store a correspondingly high number of new empty containers which, for space reasons, have to be stackable, i.e. placeable one inside another. A problem which arises during the stacking of containers is that stacked containers can often only be unstacked, i.e. separated from one another, with extreme difficulty. This can be attributed to the fact that the casing surfaces of containers stacked one inside another lie against one another in an encircling manner over a certain height and also slide along one another as they are being pulled apart, and therefore, firstly, a frictional resistance arises, and, secondly, a vacuum arises in the intermediate space between the containers.

A second problem with the storage of the filled and closed containers arises because of the requirement of storing and transporting said containers in as space-saving a manner as possible. For this purpose, containers of different sizes have to be able to be stacked securely on one another. This means that the bottom surfaces of the upper containers of any size are centred neatly on the lid surfaces of the lower containers of any size.

GENERAL DESCRIPTION

Consequently, it is the object of the present invention to provide a set of containers of the type mentioned at the beginning, which set overcomes the aforementioned disadvantages and is distinguished by space-saving stackability and simple unstackability.

This object is achieved in that even the bases of all of the containers of the set are identical, and the at least one wall portion of the respective casing of all of the containers of the set in each case have a rectilinear portion in which, in each vertical projection plane parallel to a vertical axis of the container, the wall portion leaves behind two trace lines which diverge toward the opening cross section and each enclose an angle of at least 2 degrees, preferably an angle of between 2 degrees and 5 degrees, with the vertical axis, and a transition portion which is assembled from two arc portions and the intersection curve of which with each vertical projection plane parallel to the vertical axis of the container merges tangentially both into the rectilinear portion and into a respective intersection curve of the base, wherein an arc portion adjacent to the rectilinear portion has a greater radius than an arc portion adjacent to the base, and the two arc portions merge tangentially into each other.

It is already customary in the prior art to design the opening cross section of containers of different internal volumes identically, and therefore identical lids can be used for closing the containers. According to the invention, however, the base of the various containers is also configured identically, which has the advantage that good stackability of closed containers, i.e. containers provided with a lid, is achieved, wherein the containers can have different internal volumes. By this means, flexibility is provided in the storage and use of containers of various sizes, which permits an optimum choice of the respectively required container size.

The fact that the at least one wall portion of the respective casing of all of the containers of the set in each case has a rectilinear portion in which, in each vertical projection plane parallel to a vertical axis of the container, the wall portion leaves behind two trace lines which diverge towards the opening cross section and each enclose an angle of at least 2 degrees or between 2 degrees and 5 degrees with the vertical axis, means that the cross section of the base of the containers is smaller in this region than the respective opening cross section of same. The vertical axis of the containers typically coincides with the vertical, and the term "rectilinear portion" should be understood as meaning a surface.

With this inclined profile of the wall portion, it has been shown that, when the containers are stacked one inside another, only a very small part of the relevant inner or outer casing surface of stacked containers comes to lie against one another, and therefore the frictional resistance during the unstacking is only small. With regard to the vacuum which arises during the unstacking of conventional containers, is has furthermore been shown that, because of the inclination according to the invention of the casing surfaces, even a small relative displacement of the stacked container suffices in order to provide a slot for ambient air flowing in, and therefore a vacuum cannot arise. Stacked containers according to the invention can therefore be released again from one another or unstacked without great effort. Accordingly, an angle has been found which, firstly, is as large as possible, in order to ensure a sufficient cross section for ventilation during the unstacking of the nested containers, and, secondly, is not too large since otherwise, in particular in the case of the large containers, with the opening cross section being the same the base standing surface would turn out to be inappropriately small.

The positive effect of the inclined wall portion can be increased if the containers of the set have a plurality of such wall portions. It is also possible for the entire casing surface to be correspondingly inclined, and therefore the casing surface of the containers encloses an angle of at least 2 degrees, preferably of between 2 degrees and 5 degrees, with the vertical in an encircling manner.

In order to make it possible at all for containers in each case having different internal volumes to have an identical opening cross section on the upper side and an identical base, the containers of the set, with the rectilinear portions in each case inclined identically, have to have a transition portion which in each case differs in design and is located between the rectilinear portion and the base and therefore provides a connection between the rectilinear portion and the base. The transition portion merges tangentially both into the rectilinear portion and into the base, wherein the profile of the transition portion can consist or be composed of arcs, circular arcs, elliptical arcs and straight lines. However, any other profile is also conceivable, wherein advantageously there should not be any bends or turning points. This should be taken into consideration primarily in respect of high stability.

Alternatively, containers having different internal volumes and an identical opening cross section on the upper side and with an identical base can also be obtained by the fact that the containers of the set have an identical transition portion and rectilinear portions with different inclinations.

For the provision of different internal volumes, the containers of the set according to the invention therefore have a different height which is compensated for by the different design of the respective transition portion. The at least two containers here can have any desired internal volume, but in practice internal volumes of 30 liters, 50 liters and 60 liters have proven particularly useful. With regard to the stability and tightness of the containers, the latter can be manufactured from plastic.

It goes without saying that the containers can have any desired cross section, i.e. for example, can have a polygonal, round or elliptical cross section. Mixed forms of round and angular cross sections are also possible, for example a rectangular cross section with rounded corners. Owing to the fact that at least one portion of the container is inclined in relation to the vertical, an upper cross-sectional area is greater than a cross-sectional area located below. The casing can also be inclined overall in relation to the vertical.

According to the invention, the transition portion is composed of two arc portions, wherein an arc portion adjacent to the rectilinear portion has a larger radius than an arc portion adjacent to the base, and the two arc portions merge tangentially into each other. The transition portion as such therefore does not have any bend either.

In this regard, it is furthermore of advantage if the arc portion adjacent to the base has the same curvature in all of the containers of the set. This means that the transition from the base into the transition portion is of identical design in all of the containers of the set, which is expedient in respect of the use of a standard lid of the containers, onto which lid a full container which is to be stacked comes to stand. Owing to the different internal volumes of the containers of the set, said internal volumes typically being achieved by rectilinear portions of different length, the arc length of the arc portions which are adjacent to the base, of the various containers differs while the curvature is identical.

At least one portion can be designed as a circular arc portion, wherein it has proven advantageous if a circular arc portion adjacent to the base has a radius of between 12 mm and 18 mm, preferably a radius of 15 mm.

Furthermore, it is conceivable for the transition portion to be composed of two arc portions which preferably connect by means of a straight line.

According to a variant embodiment of the set according to the invention, an upper side of all of the containers of the set, said upper side surrounding the opening cross section, is in each case provided with an encircling edge flange which is provided in an encircling manner with latching openings which are each spaced apart from one another in a spread out manner. Accordingly, the containers of such a set are suitable as waste containers in hospitals or other medical sectors in which the containers are permanently closed after filling with corresponding lids. The known lids are distinguished by snap hooks which are arranged in an encircling manner and are introduced into the aforementioned latching openings.

With regard to closing at least one container of the set, it is of advantage if the set according to the invention comprises a lid with a surface matched to the base of the containers, and with an elevation which is matched to the transition portion of the at least one wall portion and starts from a supporting surface, wherein, in a stacked state of two containers, of which the lower is provided with a lid, regions of the transition portion are supported on contact surfaces of the elevation. The elevation can also be understood as a bead or step. The lid designed in such a manner ensures that any container of the set can be closed, wherein another container of the set can be positioned on the container closed with the lid. The corresponding design of a lower side of the container and an upper side of the lid gives rise, during the stacking of two containers, to a stable and precisely predefined position of the container located uppermost. Of course, the set according to the invention can include a number of identically designed lids corresponding to the number of containers of the set. In the event that the containers have a plurality of wall portions with a rectilinear portion and transition portion and the lid is accordingly provided with a plurality of elevations, a particularly positionally precise stacking of two containers is ensured. According to an advantageous refinement of the set, the containers have in an encircling manner a transition portion and the lid or the lids has or have an encircling elevation.

Furthermore, it is of advantage if the base of the at least two containers has an encircling flat standing surface and a preferably centrally arranged depression in the direction of the internal volume, said depression preferably having an approximately rectangular cross section. This is advantageous in particular since the lid in this case can be provided with a centrally arranged handle without adversely affecting the stackability of closed containers. The geometry of the depression in the base of the containers is then matched to the geometry of the handle on the lid.

Finally, it should be noted that the various features of the dependent claims can be realized individually per se or a plurality of said features can be realized in any desired combinations in variants of the invention.

BRIEF DESCRIPTION OF THE DRAWINGS

The above-described invention is explained in more detail below with reference to exemplary embodiments which are illustrated in the figures.

DETAILED DESCRIPTION

Figure 1C:
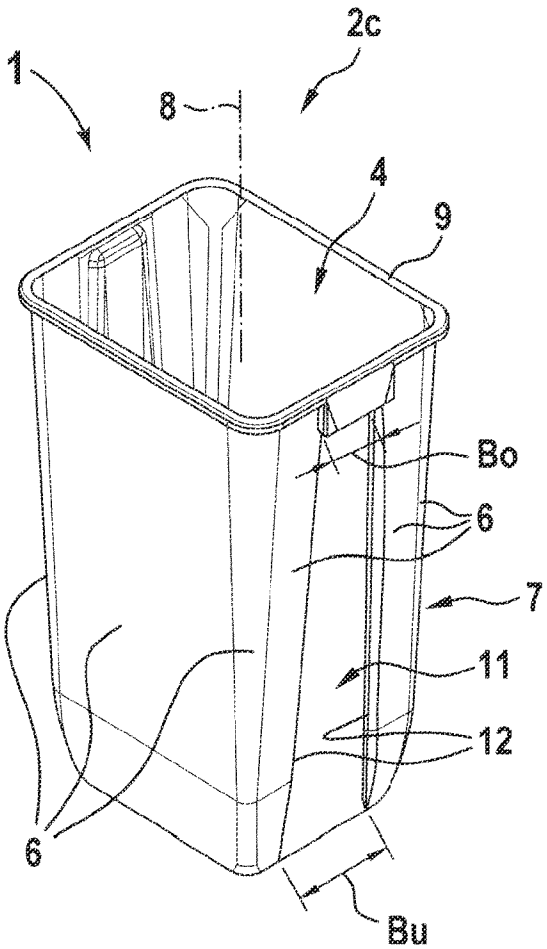
FIG. 1: shows a three-dimensional view of a set according to the invention.
Figure 1B:
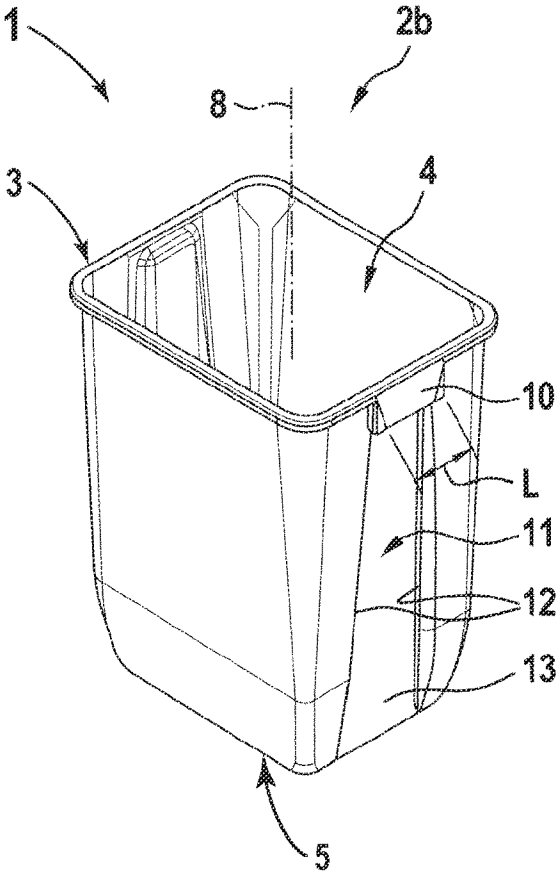
Figure 1A:
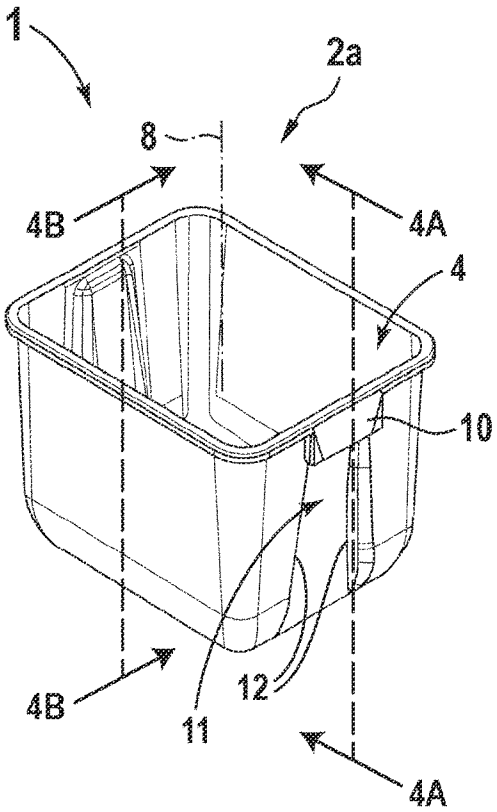

An exemplary embodiment for a set 1 according to the invention consisting of a plurality of containers 2 each having different internal volumes is shown as a three-dimensional view in FIG. 1, wherein the set 1 comprises a first container 2*a* with an internal volume of 30 liters, a second container 2*b* with an internal volume of 50 liters, and a third container 2*c* with an internal volume of 60 liters. The containers 2 each have a rectangular cross section with rounded corners, wherein the cross section is continuously reduced in size from an opening cross section 4 located on an upper side 3 as far as a base 5. This is due to the fact that wall portions 6 of the casing 7 of the individual containers 2 run at an inclination in relation to a vertical axis 8 of the respective container 2. On the upper sides 3, the three containers 2 each have an encircling edge flange 9 which is provided with latching openings (not illustrated specifically) for the insertion of corresponding snap hooks of a lid (not illustrated).

On opposite short sides, the three containers 2 are likewise each provided on their upper side 3 with a carrying tab 10. In order to permit comfortable engagement in the carrying tabs 10 and to increase the stability of the container 2 in the region of the carrying tabs 10, the containers 2 on their short side surfaces have an indentation 11 which runs vertically and the width B of which at the upper side 3 of the containers 2 approximately corresponds to a length L of the carrying tab 10, whereas the width Bu thereof on the base 5 of the containers 2 is larger. Consequently, two opposite ribs 12 of the indentation 11 run obliquely with respect to each other. A bottom 13 of the indentation 11 is designed as a rectilinear surface, wherein the bottom 13 of the indentation 11 adjoins the base 5 likewise in an arcuate manner. The geometry of the remaining casing surface of the containers 2 is discussed in more detail in the following figures.

Figure 2C:
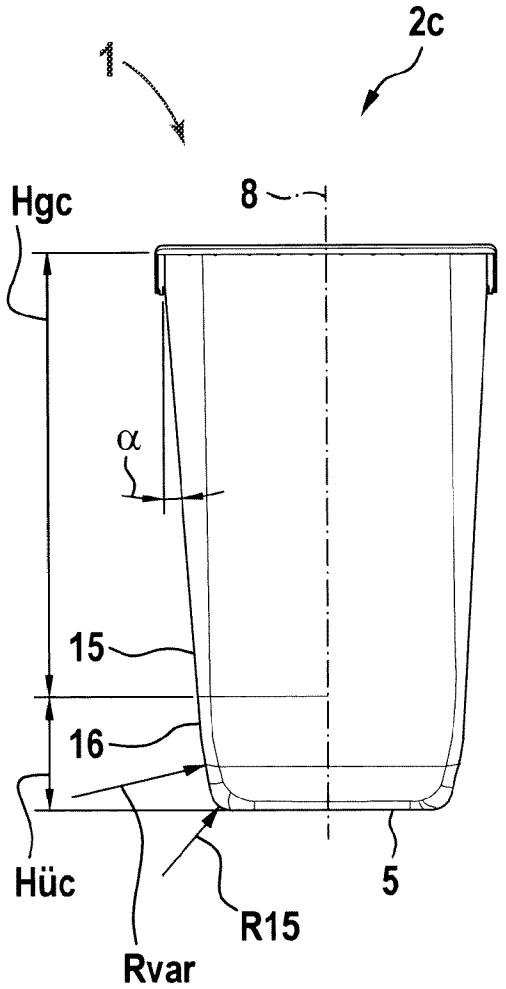
FIG. 2: shows a front view of the set according to FIG. 1.
Figure 2B:
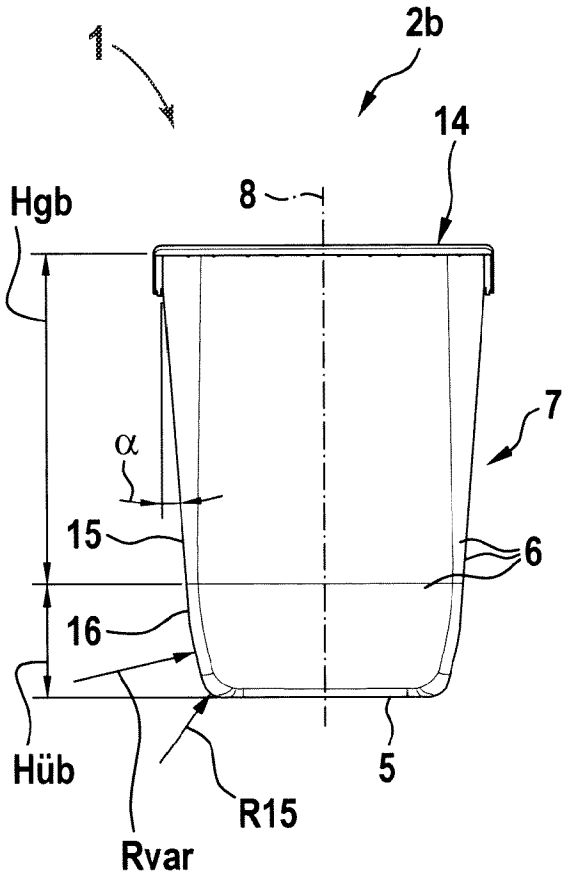
Figure 2A:
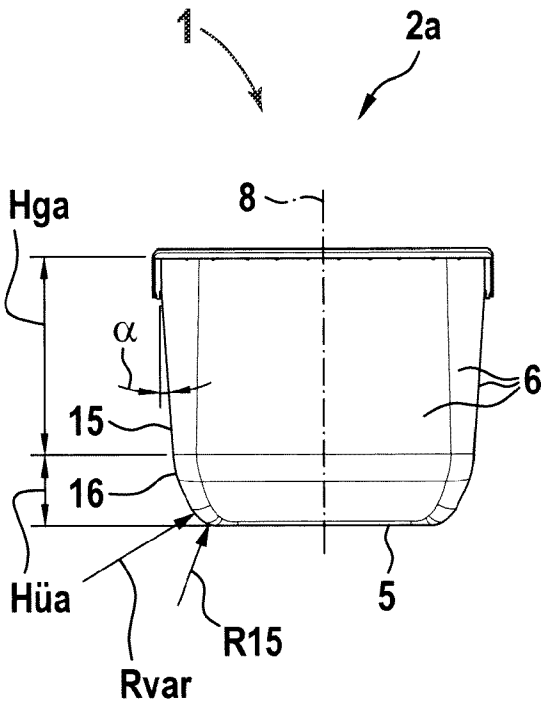

FIG. 2 shows the set 1 in a two-dimensional view looking at the long side surfaces. It becomes clear from FIGS. 1 and 2 that the first container 2*a*, the second container 2*b* and the third container 2*c* each have an identical opening cross section 4 with an identical edge flange 9 and an identical base 5, wherein the containers 2 in FIG. 2 are each provided with an identical lid 14. While the base 5 of the containers 2 runs horizontally, wall portions 6 of the casing 7 of the containers 2 are each inclined in a rectilinear portion 15 in such a manner that they enclose an angle $\alpha$ of 3° with the vertical axis 8 which runs perpendicularly to the base 5 and, in the present exemplary embodiment, corresponds to a vertical. The containers 2 have rectilinear portions 15 in an encircling manner, i.e. rectilinear surfaces which enclose the angle $\alpha$ with the vertical axis 8.

Located between the base 5 and the rectilinear portions 15 is in each case a transition portion 16, the intersection curve of which with each intersection plane parallel to the vertical axis 8 of the container 2 merges tangentially into the rectilinear portion 15 and into a respective trace line of the base 5. Accordingly, the rectilinear portion 15 merges without a bend into the transition portion 16 and the transition portion 16 merges without a bend into the base 5.

It can be seen in FIG. 2 that the transition portion 16 is in each case designed as an arc consisting of two circular arc portions with different radii R15 and Rvar, wherein the circular arc portion R15 of 15 mm in each case adjoins the base 5. The circular arc portion R15 is adjoined, in the case of the first container 2 with an internal volume of 30 liters, by a circular arc portion Rvar with a radius of 117.2 mm, while the circular arc portion Rvar is 488.25 mm in the case of the second container 2*b* and 879.6 mm in the case of the third container 2*c*. The two circular arc portions R15 and Rvar of a container likewise merge tangentially into each other. In the case of the first container 2*a*, the circular arc length of the circular arc portion R15 is relatively short and rapidly merges into the circular arc portion Rvar. Overall, a height Hüa of the transition portion 16 of the first container 2*a* is approximately 80 mm and a height Hga of the rectilinear portion 15 is approximately 227 mm. The circular arc length of the arc R15 in the case of the second container 2*b* is larger than that of the first container 2*a* since the transition portion 16 runs more steeply because of the rectilinear portion 15 of longer design. Overall, the transition portion 16 of the second container 2*b* has a height Hüb of 130 mm and the rectilinear portion 15 has a height Hgb of 379 mm. The transition portion 16 of the third container 2*c* has a height Hüc of 130 mm and has the steepest extent. The rectilinear portion 15 of the third container 2*c* has a height Hgc of approximately 508 mm, and therefore an overall height of 638 mm arises for the third container 2*c* without a lid.

Figure 3B:
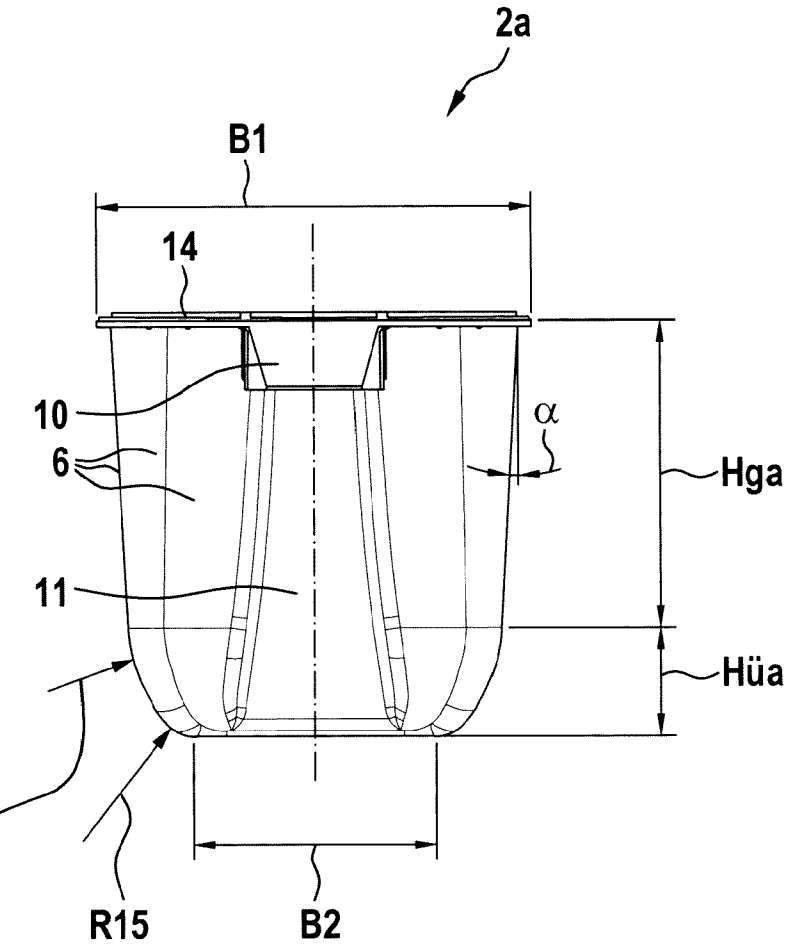
FIG. 3: shows a front and side view of the first container according to FIG. 1, FIG. 4: shows two vertical sections through the first container positioned on a lid.
Figure 3A:
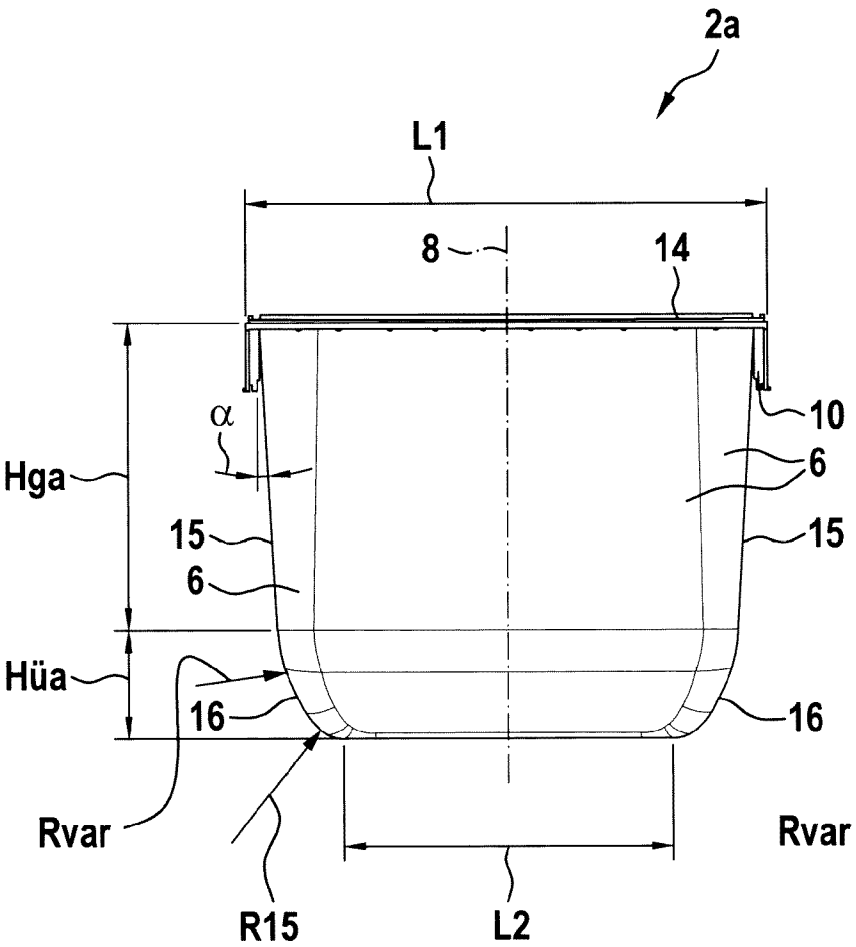

In FIG. 3, a front view of a long side surface and a side view of a short side surface of the first container 2*a* are placed opposite each other, wherein the container 2*a* is once again closed with a lid 14. Due to the approximately rectangular cross section of the opening cross section 4 of the container 2*a* and of the lid 14, the external dimensions thereof have a length L1 of 400 mm and a width B1 of 333.5 mm. The wall portions 6, which form an angle $\alpha$ of 3° with the vertical axis, together with their rectilinear portion 15 and transition portions 16 can also be readily seen in the front view. The likewise rectangular base has a length L2 of approximately 280 mm and a width B2 of approximately 210 mm.

The composition of the transition portions 16 from two circular arc portions R15 and Rvar can also be readily gathered from FIG. 3. Furthermore, the design of the carrying tabs 10 and of the indentation 11 can clearly be seen in the side view of FIG. 3.

Figure 4B:
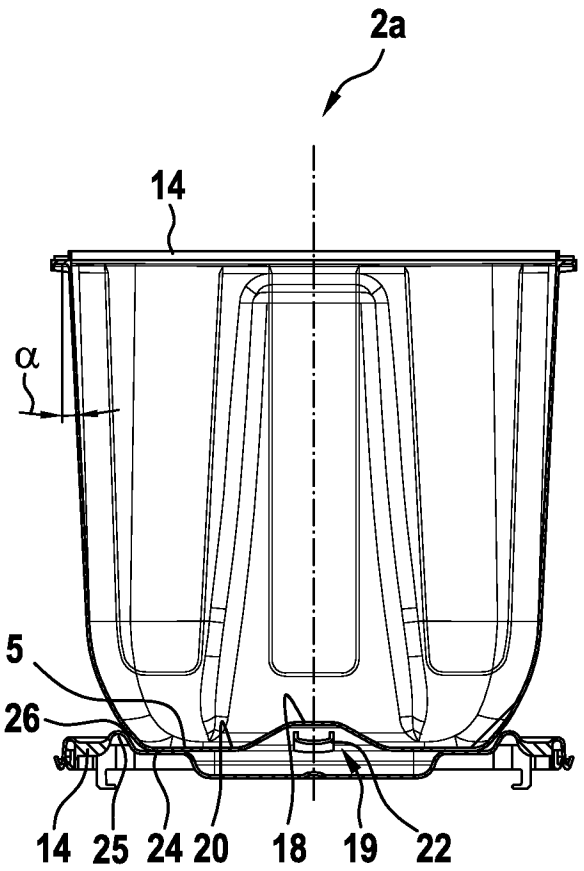
Figure 4A:
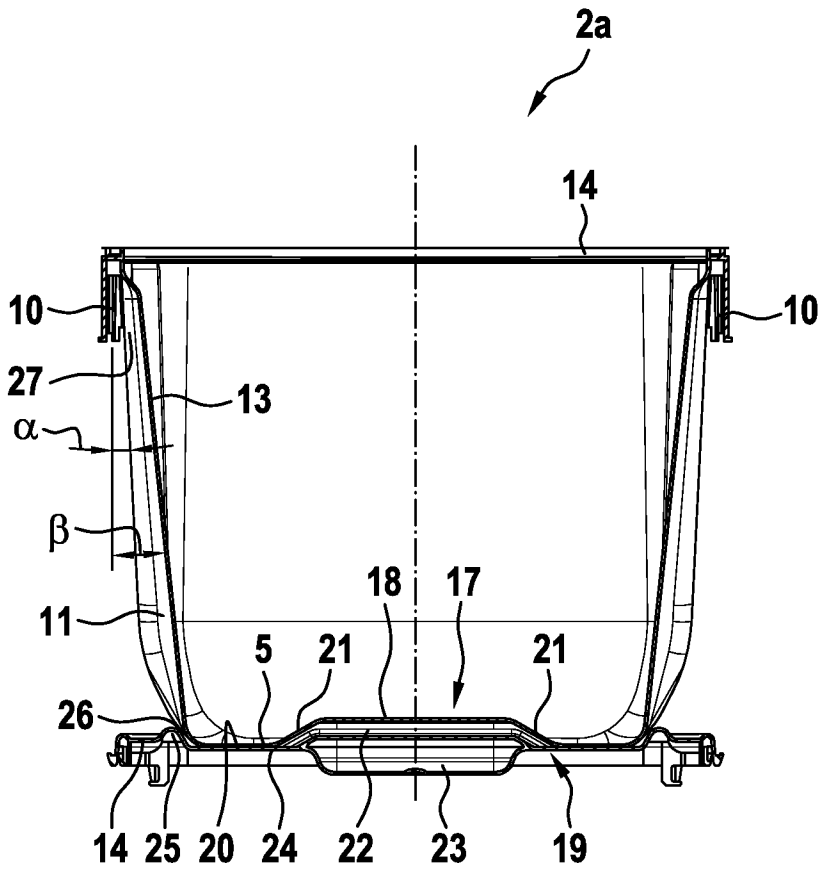

FIG. 4 shows two vertical sections through the first container 2*a* with lid 14, wherein the container 2*a* is positioned with its base 5 on a lid 14 of a further container (not illustrated further) which is located therebelow, and one vertical section runs parallel to the longitudinal sides and one vertical section is parallel to the short sides of the container 2*a*. The precise construction of the base 5 of the first container 2*a* can in particular be readily seen in FIG. 4, wherein the construction of the base 5 corresponds to that of the other containers 2 of the set. The base 5 has a centrally arranged depression 17 in the direction of the interior space of the first container 2*a*, said depression having an approximately rectangular bottom 18 with a long side and a short side and also an approximately rectangular opening cross section 19, wherein the opening cross section 19, which is aligned with a standing surface 20 of the base 5, has larger dimensions than the bottom 18 of the depression 17. Side surfaces 21 of the depression 17 therefore run obliquely between the standing surface 20 of the base 5 and the bottom 18 of the depression 17. The geometry of the depression 17 is selected in such a manner that it creates a sufficiently large clearance for accommodating a holding handle 22 which is arranged in a central region of the lid 14. In the vertical section parallel to the longitudinal sides, the depression 17 of the base 5 runs with its side surfaces 21 and its bottom 18 parallel to the partially arcuate holding handle 22 of the lid 14 located therebelow.

In the region of the holding handle 22 shaped in the form of a tab, the lid 14 has a recessed grip 23 which permits the holding handle 22 to be gripped with one hand. The standing surface 20 of the container 2*a* is supported on a flat, horizontally running supporting surface 24 of the lid 14, wherein both the standing surface 20 and the supporting surface 24 forms an encircling strip. In the vertical section parallel to the longitudinal sides, the supporting surface 24 of the lid 14 is of such a wide design that the entire standing surface 20 visible there of the container 2*a* has space thereon. In the vertical section parallel to the short sides, the supporting surface 24 is of significantly thinner design, and therefore only an outer half of the respective standing surface 20 finds space on the associated supporting surface 24.

In an edge region, the lid 14 has an encircling elevation 25 which forms a contact surface 26 facing the first container 2*a*. Said contact surface 26 is arcuate, wherein the geometry of the elevation 25 is selected in such a manner that the containers 2 of the set 1 can all be supported in an encircling manner on the contact surface 26 by means of the transition portions 16 of differing design. The elevation 25 serves firstly for centering the container 2*a* positioned thereon and secondly for a certain positional fixing of same.

The statements made with respect to the first container 2*a* regarding the geometry of the base 5 and of the lid 14 also apply to the remaining containers 2*b*, 2*c* of the set, the base 5 and lid 14 of which are of identical design.

Furthermore, the geometry of the indentation 11 of the container 2*a*, the bottom 13 of which indentation encloses an angle β of 6.3° with the vertical, can be seen in FIG. 4 in the vertical section parallel to the longitudinal sides. Behind the carrying tab 10, the indentation 11 creates a clearance 27 which makes taking hold of the carrying tab 10 comfortable.

Figure 5C:
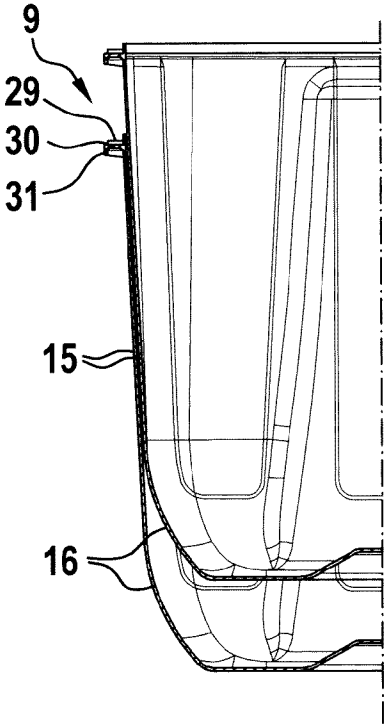
FIG. 5: shows two stacked first containers.
Figure 5B:
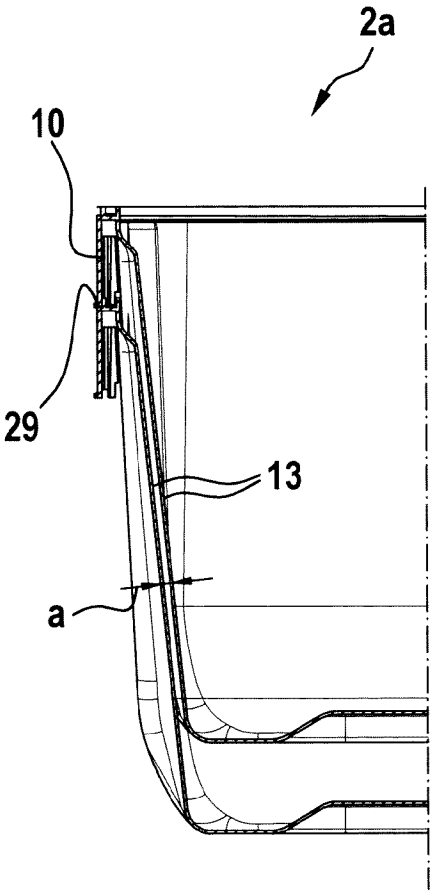
Figure 5A:
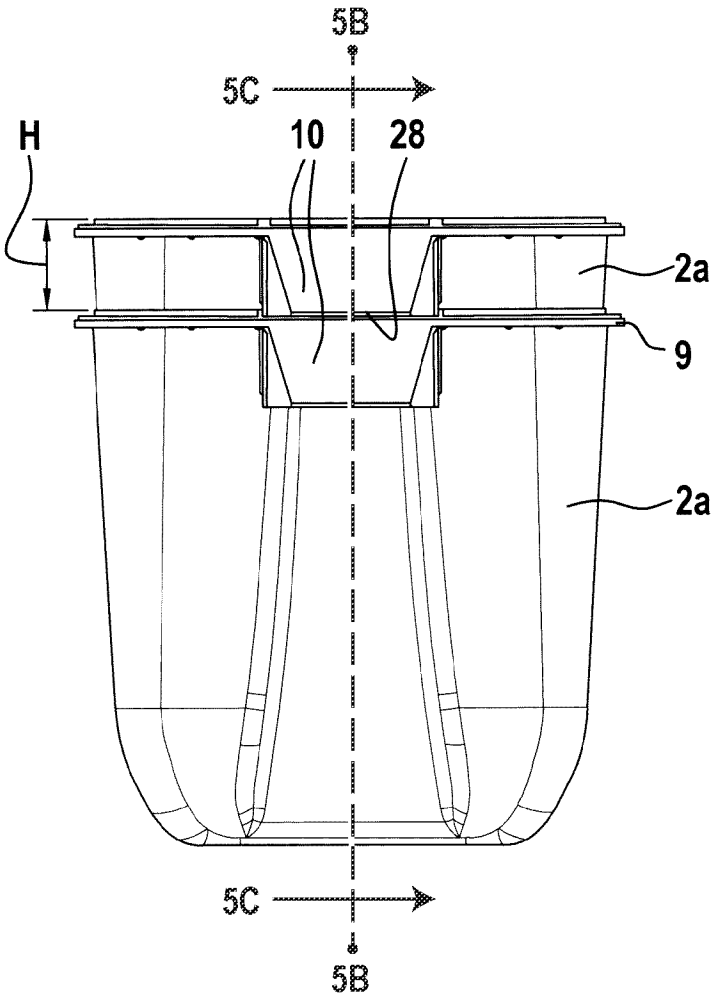
Figure 6F:
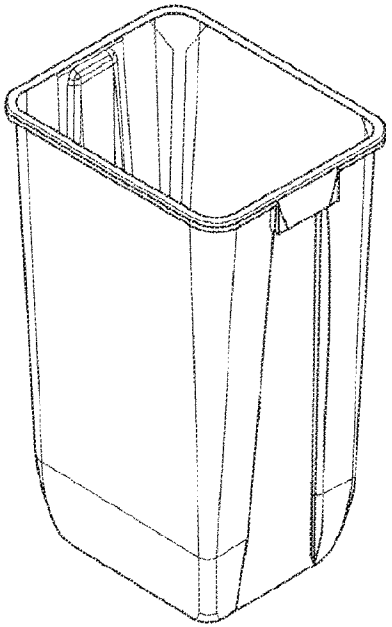
FIG. 6: shows a compilation of all of the views of the third container.
Figure 6B:
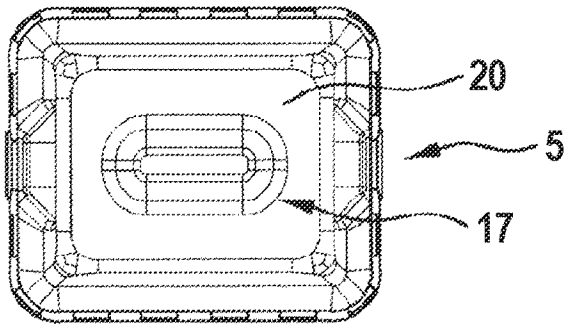
Figure 6E:
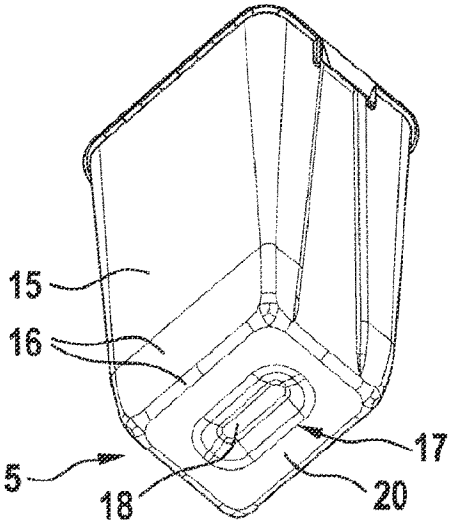
Figure 6D:
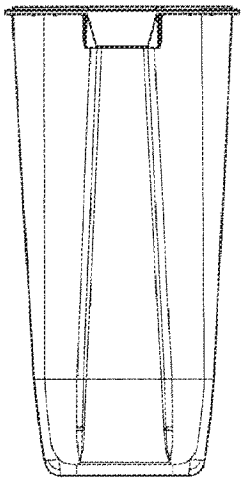
Figure 6A:
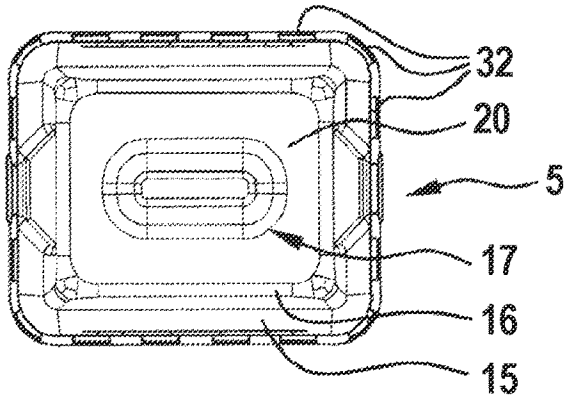
Figure 6C:
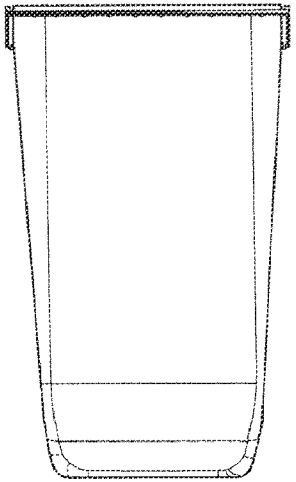

FIG. 5 shows two first containers 2*a* with an internal volume of 30 liters which are stacked one inside the other, wherein a side view, a vertical section running parallel to the longitudinal sides and a vertical section running parallel to the short sides are illustrated next to one another. It can be seen in the side view that the upper container 2*a* is supported with a lower side 28 of the carrying tab 10 on an upper side 29 of the edge flange 9 of the container 2*a* located therebelow, and therefore the upper container 2*a* protrudes by an amount of 52 mm out of the lower container 2*a*, which approximately corresponds to the height H of the carrying tab 10.

From the vertical section running parallel to the longitudinal sides, the two bottoms 13 of the indentations 11 can be seen, said bottoms running parallel to each other and being at a distance a from each other. In the vertical section running parallel to the short sides, the rectilinear portions 15 of the wall portions 6 of the two containers 2*a* likewise run parallel to each other, but do not have a spacing from one another. On the contrary, the rectilinear portions 15 lie against each other. Furthermore, the geometry of the edge flange 9 of the containers 2*a* can be seen, said edge flange being composed of a web 30 protruding from the rectilinear portion 15 and a short limb 31 running approximately vertically.

FIG. 6 is a compilation of all of the views of the third container 2*c* of the set 1, from which in particular the design of the base 5 emerges, both as viewed from the outside and as viewed from the inside, wherein the standing surface 20, the depression 15 with its bottom 18 and the adjoining transition portions 16 and rectilinear portions 15 of the wall portions 6 can be seen. The latching openings 32 which are introduced in the edge flange 9 and have already been described in the context of FIG. 1 can also be seen.

Figure 7:
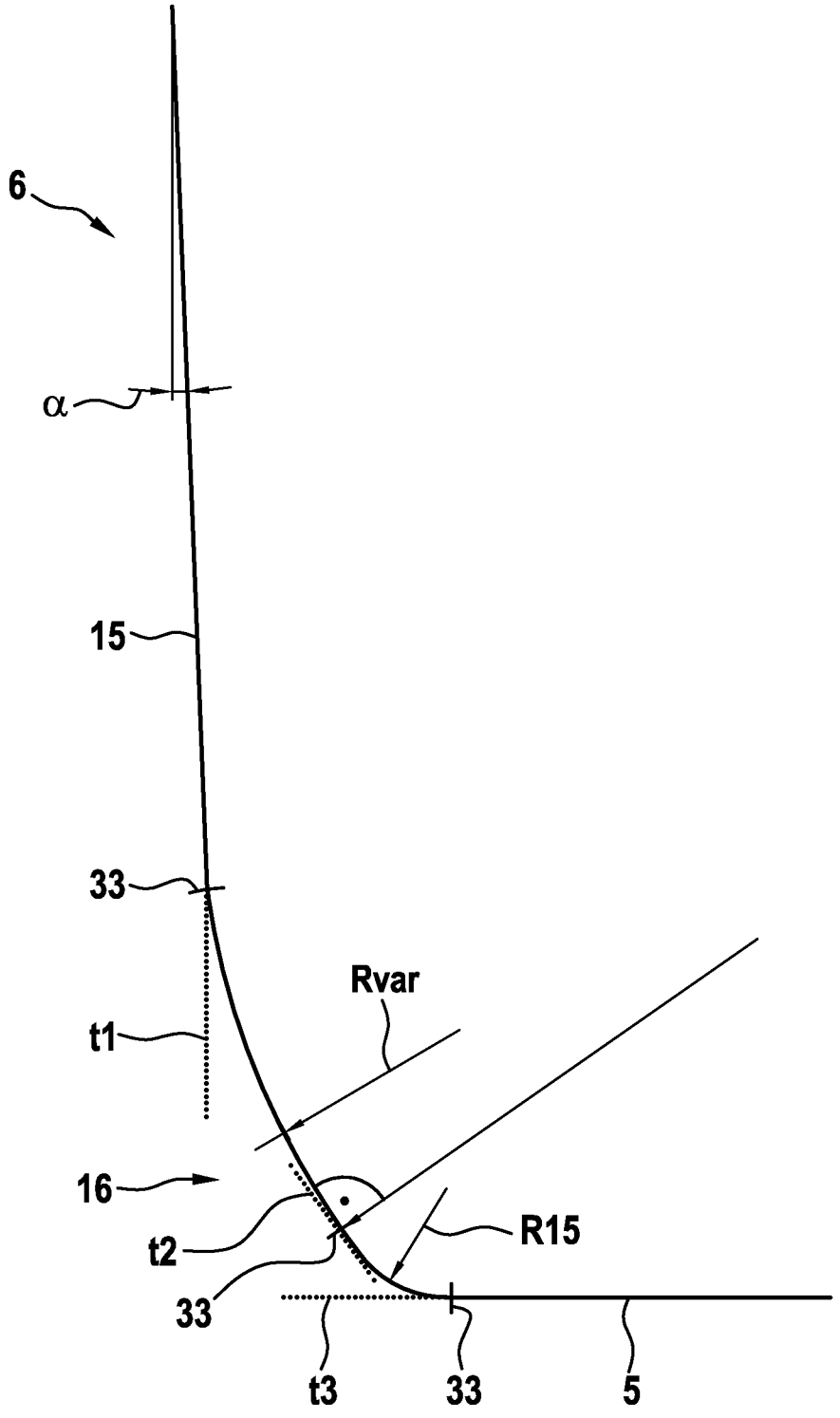
FIG. 7: shows a detailed view of the transition portion.

Finally, FIG. 7 shows a detailed view of the transition portion 16 between the rectilinear portion 15 and the base 5 of the containers 2 of the set 1 according to the invention, in which the individual tangents t1, t2, t3 at the transitions between the rectilinear portion 15, the circular arc portion Rvar, the circular arc portion R15 and the base 5 are also drawn as dotted lines. The tangent t1 which defines the transition between the rectilinear portion 15 and the circular arc portion Rvar of the transition portion 16 corresponds to the continuation of the rectilinear portion 15 and therefore likewise forms an angle α of 3° with the vertical. The tangent t2 forms a right angle with the two radii of the circular arc portions R15 and Rvar which run in an identical manner at the transition point. The tangent t3 is once again a continuation of the base 5 and therefore runs horizontally. For better identification of the individual portions of the wall portion 6, the latter is provided with short separating lines 33.

The invention claimed is:

1. A set comprising at least two containers each having different internal volumes, wherein the containers each has:

a base, a casing adjoining the latter in an encircling manner, and an opening cross section which is defined by an end of the casing that faces away from the base and opens up access to the respective internal volume, wherein at least one wall portion of the respective casing runs at an inclination in relation to a vertical axis of the container, said vertical axis running perpendicularly to the base, in such a manner that an internal cross section of the container that is defined in each case by the casing decreases continuously from the opening cross section as far as the base, and the opening cross sections of all of the containers of the set are identical, characterized in that even the bases of all of the containers of the set are identical, and the at least one wall portion of the respective casing of all of the containers of the set in each case has a rectilinear portion in which, in each vertical projection plane parallel to a vertical axis of the container, the at least one wall portion leaves behind two trace lines which diverge toward the opening cross section, and each enclose an angle (α) between 2 degrees and 5 degrees, with the vertical axis, and a transition portion which is assembled from two arc portions and the intersection curve of which with each vertical projection plane parallel to the vertical axis of the container merges tangentially both into the rectilinear portion and into a respective intersection curve of the base, wherein an arc portion adjacent to the rectilinear portion has a greater radius than an arc portion adjacent to the base, and a different radius for each container of the set, and the two arch portions merge tangentially into each other.

2. The set as claimed in claim 1, characterized in that the arc portion adjacent to the base has the same curvature in all of the containers of the set.

3. The set as claimed in claim 1, characterized in that at least one arc portion is designed as a circular arc portion (R15, Rvar) or elliptical portion or catenary curve.

4. The set as claimed in claim 1, characterized in that an upper side of all of the containers of the set, said upper side surrounding the opening cross section, is in each case provided with an encircling edge flange which is provided in an encircling manner with latching openings which are each spaced apart from one another in a spread out manner.

5. The set as claimed in claim 1, characterized by a lid with a surface matched to the base of the containers, and with an elevation which is matched to the transition portion of the at least one wall portion and starts from a supporting surface, wherein, in a stacked state of two containers, of which the lower is provided with a lid, regions of the transition portion are supported on contact surfaces of the elevation.

6. The set as claimed in claim 1, characterized in that the base of the at least two containers has an encircling flat standing surface and a preferably centrally arranged depression in the direction of the internal volume, said depression preferably having an approximately rectangular cross section.

* * * * *